US010837668B2

(12) United States Patent
Ye

(10) Patent No.: US 10,837,668 B2
(45) Date of Patent: Nov. 17, 2020

(54) OUTDOOR GAS HEATER

(71) Applicant: Hong-Xu Ye, Beihai (CN)

(72) Inventor: Hong-Xu Ye, Beihai (CN)

(73) Assignee: GERMANIA HOME APPLIANCE CO., LTD., Guangdong (CN)

( * ) Notice: Subject to any disclaimer, the term of this patent is extended or adjusted under 35 U.S.C. 154(b) by 39 days.

(21) Appl. No.: 16/263,011

(22) Filed: Jan. 31, 2019

(65) Prior Publication Data

US 2020/0208858 A1 Jul. 2, 2020

(30) Foreign Application Priority Data

Dec. 26, 2018 (CN) ..... 2018 1 1597213

(51) Int. Cl.

| | |
|---|---|
| ***F24F 11/30*** | (2018.01) |
| ***F23D 14/12*** | (2006.01) |
| ***F23D 14/72*** | (2006.01) |
| ***F24C 3/08*** | (2006.01) |
| ***F25B 41/04*** | (2006.01) |
| ***F24C 3/02*** | (2006.01) |
| ***F24C 3/10*** | (2006.01) |

(52) U.S. Cl.

CPC ..... *F24F 11/30* (2018.01); *F23D 14/12* (2013.01); *F23D 14/72* (2013.01); *F24C 3/08* (2013.01); *F25B 41/04* (2013.01); *F23D 2203/103* (2013.01); *F23D 2203/1012* (2013.01); *F24C 3/02* (2013.01); *F24C 3/103* (2013.01)

(58) Field of Classification Search

CPC ..... F24F 11/30; F25B 41/04; F23D 14/12; F23D 14/72; F23D 2203/1012; F23D 2203/103; F24C 3/08; F24C 3/103; F24C 3/02

See application file for complete search history.

(56) References Cited

U.S. PATENT DOCUMENTS

2014/0165991 A1* 6/2014 Noman ..... F24H 9/0068 126/116 A

* cited by examiner

*Primary Examiner* — David J Laux

(57) ABSTRACT

The present invention discloses an outdoor gas heater, comprising an outer cover, an outer cover side baffle, a gas injection pipe, a ceramic burner, a body box, a control box connecting support frame, a control box sealing plate, a control box, a wall-mounted bracket and a long open a flame connecting pipe. Four ceramic burners are fixed side by side in the body box, a gas injection pipe is fixed on the lower side of the body box, and a gas injection pipe is sealingly connected to the four ceramic burners; the outer open end of the body box is locked to the outer cover, and the side of the body box opposite to the outer opening thereof is locked to the control box connecting support frame. The control box connecting support frame is a U-shaped structure, and side wall of which is locked on both sides of the control box, and the outer side opening of the control box is locked to the control box sealing plate; the side of the control box opposite to the outer opening is locked to the wall-mounted bracket. The structure is reasonable in design and convenient to use, and its installation and use is very convenient and safety is greatly improved; moreover, it can save energy and maintain the demand for power supply for a long time.

10 Claims, 4 Drawing Sheets

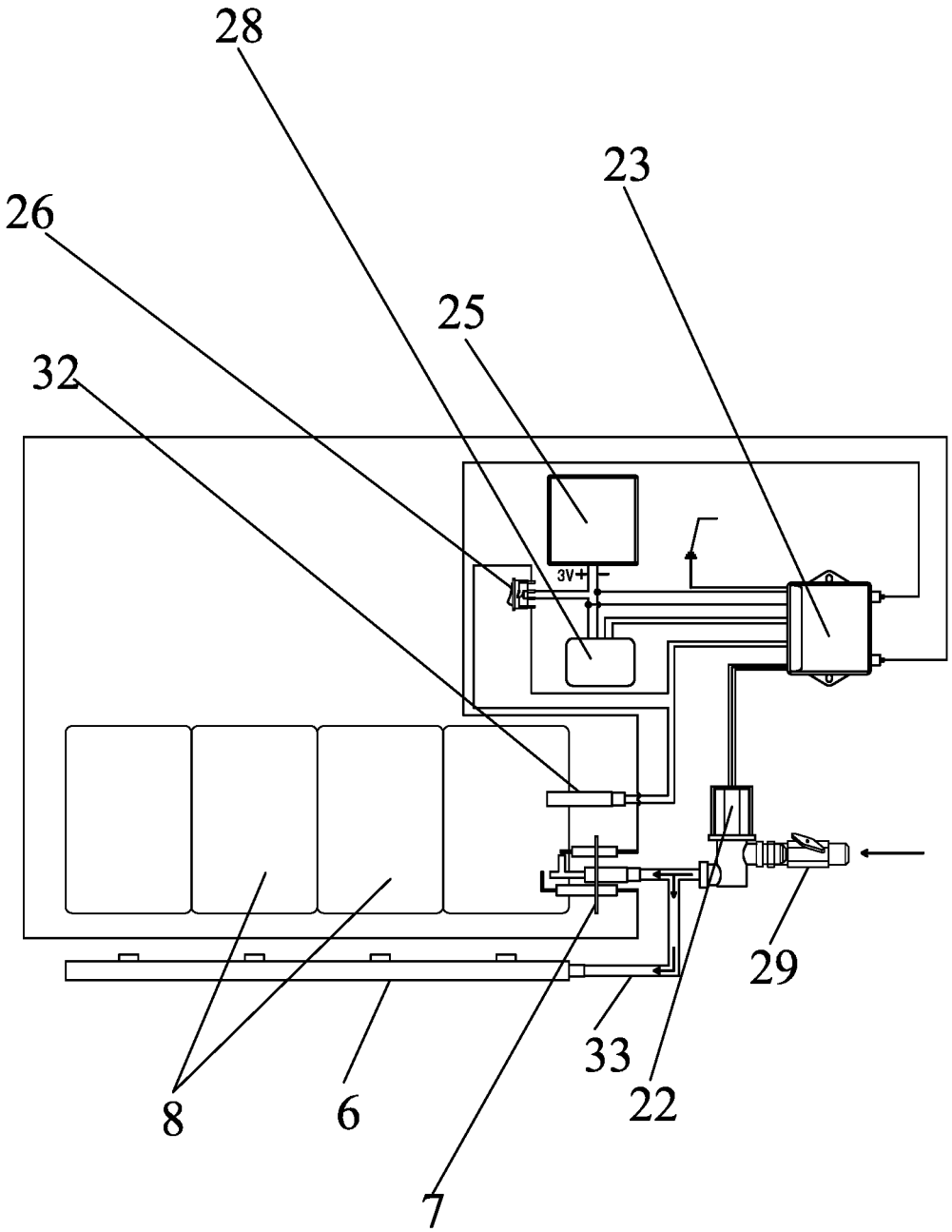
FIG. 4
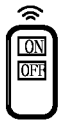

OUTDOOR GAS HEATER

FIELD OF THE INVENTION

The present invention relates to the technical field of heating equipment, and in particular to an outdoor gas heater.

BACKGROUND

During the use of the outdoor gas heater, there are two circumstances. The first is that most products use batteries and do not require AC power. However, the manual operation is not very convenient, for example, for the wall-mounted type and the upright type, the switch is in a high position, and it is inconvenient to reach. Although the installation is simple and safe, it is inconvenient to use. The second is that some products adopt AC power supply, which can be operated remotely, but it cannot work in the absence of AC power, which greatly limits the scope of application. Although it is easy to operate, its application is limited and it is inconvenient to install.

SUMMARY

The object of the present invention is to provide an outdoor gas heater, which overcomes the deficiencies of the prior art. It is reasonable in structural design and convenient to use. Its installation and use is very convenient and safety is greatly improved; moreover, it can save energy and maintain the demand for power supply for a long time.

To achieve the foregoing object, the present invention adopts the following technical solutions.

An outdoor gas heater, comprising an outer cover, an outer cover side baffle, a gas injection pipe, a ceramic burner, a body box, a control box connecting support frame, a control box sealing plate, a control box, a wall-mounted bracket and a long open flame connecting pipe, the body box is a rectangular hollow structure with an outside opening, four ceramic burners are fixed side by side in the body box, a gas injection pipe is fixed on the lower side of the body box, and a gas injection pipe is sealingly connected to one side of the gas inlet pipe, four gas outlets are arranged side by side on the gas injection pipe, and the four gas outlets are respectively sealed to pass through the body box, and sealingly connected to the four ceramic burners one by one, and gas is supplied to the four ceramic burners through the gas injection pipe respectively; the outer open end of the body box is locked to the outer cover, and a plurality of through holes are arranged side by side on the outer cover, and the outer cover is fixed with the outer cover side baffle on both sides respectively; the side of the body box opposite to the outer opening thereof is locked to the control box connecting support frame, the control box connecting support frame is a U-shaped structure, and the side wall of which is locked on both sides of the control box, and the control box is a rectangular hollow structure with an outside opening, the outer side opening of the control box is locked to the control box sealing plate; the side of the control box opposite to the outer opening is locked to the wall-mounted bracket;

The control box is mainly provided with a solenoid valve, a signal processor, a battery box, and a remote control receiver, the solenoid valve is locked at the bottom of the inner side of the control box, and the gas inlet of the solenoid valve extends to the outside of the control box, and sealingly connected to the gas inlet pipe, the gas outlet of the solenoid valve is sealingly connected to one end of the gas inlet pipe, to supply gas to the gas injection pipe, the other end of the gas injection pipe is sealingly connected to one end of the long open flame connecting pipe, and the other end of the long open flame connecting pipe is sealingly connected to a long open flame component, to supply gas to the long open flame component through the long open flame connecting pipe; the solenoid valve is connected to the signal processor through a line, the signal processor is locked at the top of the inside of the control box, the signal processor is connected to the battery box and the remote control receiver through the line respectively, and the battery box and the remote control receiver are connected by the line, the battery box, the remote control receiver are locked at the bottom of the inner side of the control box respectively, the battery box is provided with a battery that supplies electric energy to the signal processor, the remote control receiver, and the solenoid valve, when the ignition is successful, the power supply is no longer supplied to the solenoid valve, and only low-energy output maintains the signal transmission of the control box; an external remote controller is provided to match the remote control receiver, to control on/off.

The signal processor is fixed by a signal processor platen and a gland, and the signal processor platen is locked at the top of the inner side of the control box. The remote control receiver is fixed by a remote control receiver platen and a gland, and the remote control receiver platen is locked at the bottom of the inner side of the control box.

The solenoid valve extends to the gas inlet at the outside the control box to sealingly connect the manual valve.

Along open flame component is fixed on the left support plate of the body box, and the long open flame component is disposed opposite to the lower portion of the ceramic burner, and the main structure comprises a bracket, a sheet, an ignition nozzle, a nozzle, an ignition pin, an induction pin; the long open flame component is used to ensure long-term open flame to maintain the induction of the induction pinwhen the normal ignition of the ignition pin is successful, and when the open flame is extinguished unexpectedly, the induction pin will feed back the corresponding signal to cut off the solenoid valve, to avoid gas leakage.

The long open flame component is sleeved with a thermocouple, the thermocouple is connected to the signal processor through a line, and the thermocouple is used to supply power to maintain continuous work of the solenoid valve after successful normal ignition.

A long open flame shelter box is buckled on the outside of the long open flame component, and the long open flame shelter box is fixed to the left support plate of the body box.

The remote control receiver is used to receive a switch signal of the remote controller, and then issue a corresponding command to the signal processor, to control the working of the ignition pin of the long open flame component.

After the signal processor receives the power-on signals, the ignition pin of the long open flame component starts to ignite and turn on the solenoid valve. After the ignition is successful, the induction pin of the long open flame component will feel the flame temperature and continue to work.

The solenoid valve is used to continuously receive the induction signals of the induction pin of the long open flame component during normal operation, and cut off the gas supply when the signals are interrupted unexpectedly; in addition, cut off gas supply when shutdown signal is received from the remote controller.

The two inner sides of the body box are respectively locked to a right support plate and a left support plate, and the left end of the right support plate is locked to the right burner-fixed bracket, the right end of the left support plate is locked to the left burner-fixed bracket, and the upper end between the right burner-fixed bracket and the left burner-fixed bracket is respectively locked to both ends of the upper burner-fixed bracket, and the lower end between the right burner-fixed bracket and the left burner-fixed bracket is respectively locked to both ends of the lower burner-fixed bracket, the ceramic burners are fixed side by side in a rectangular frame consisting of the right burner-fixed bracket, the left burner-fixed bracket, the lower bracket and the upper bracket.

A ceramic plate intermediate baffle is disposed between two adjacent ceramic burners, and the upper and lower ends of the ceramic plate intermediate baffle are fixed on the upper bracket and the lower bracket respectively.

A ceramic plate upper platen is disposed between the upper end of the ceramic burner and the upper bracket, and a ceramic plate lower platen is disposed between the lower end of the ceramic burner and the lower bracket.

The upper side of the body box is screwed to the water baffle, the water baffle is a Z-shaped structure, and the water baffle is shielded on the upper side of the outer cover to prevent rainwater from entering the inside of the outer cover.

The inside of the outer cover is provided with an outer cover bracket at top and down, and the outer cover bracket is locked on the body box.

The outdoor gas heater in the present invention can achieve the following beneficial effects. The structure of the invention is reasonable and convenient to use, and its installation and use is very convenient and safety is greatly improved; moreover, it can save energy and maintain the demand for power supply for a long time. The outdoor installation environment needs not to provide additional power supply, and the manual operation distance is not required during operation, which greatly improves the convenience and safety of use.

BRIEF DESCRIPTION OF THE DRAWINGS

FIG. 4 is a circuit schematic diagram of the outdoor gas heater of the present invention;

DETAILED DESCRIPTION

Figure 1:
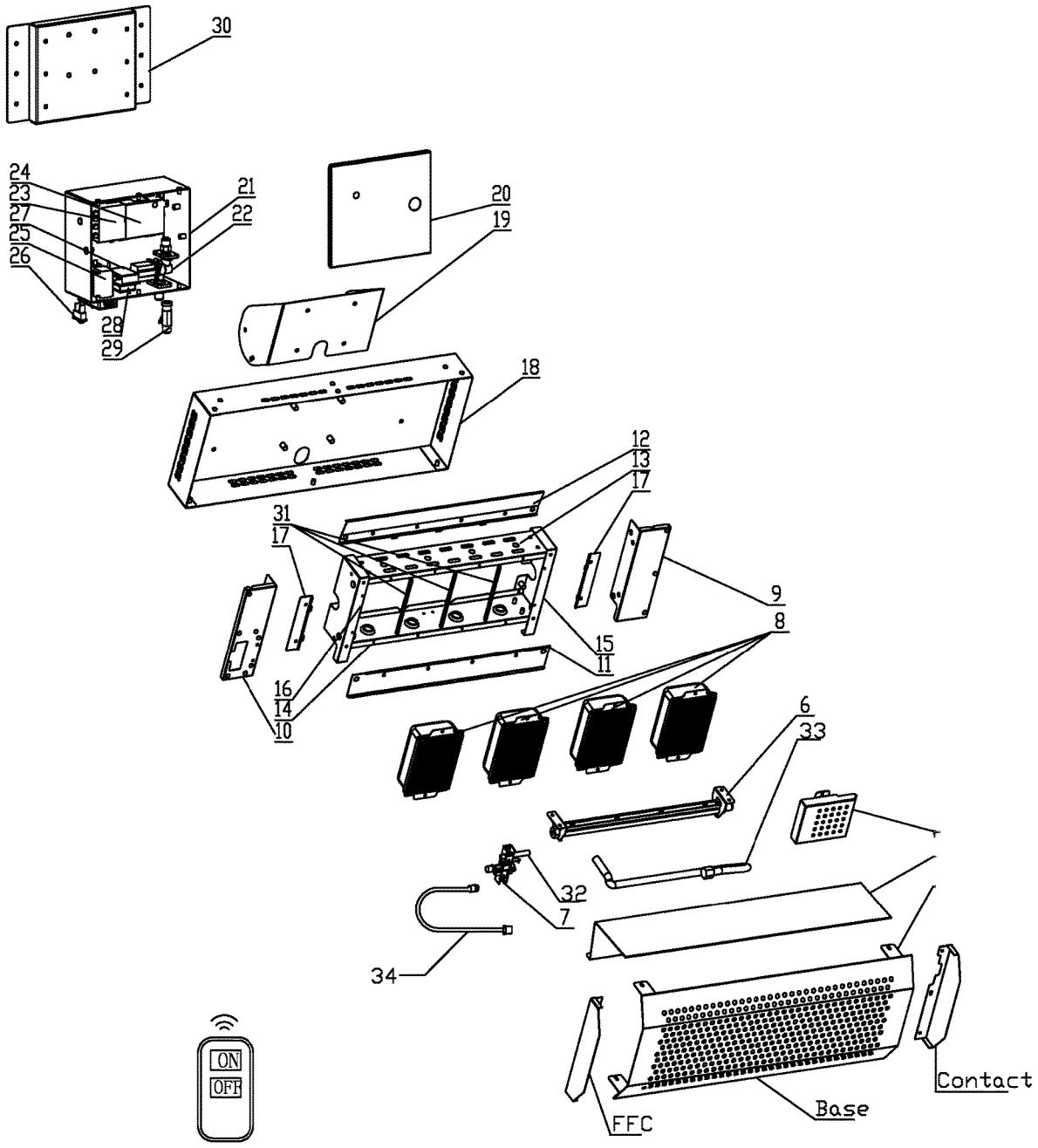
FIG. 1 is an exploded view of the outdoor gas heater of the present invention.
Figure 2:
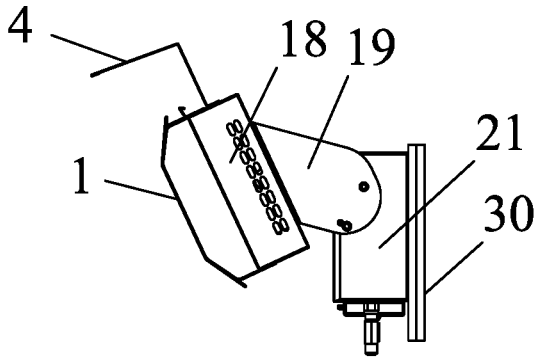
FIG. 2 is a schematic diagram of the outdoor gas heater of the present invention.
Figure 3:
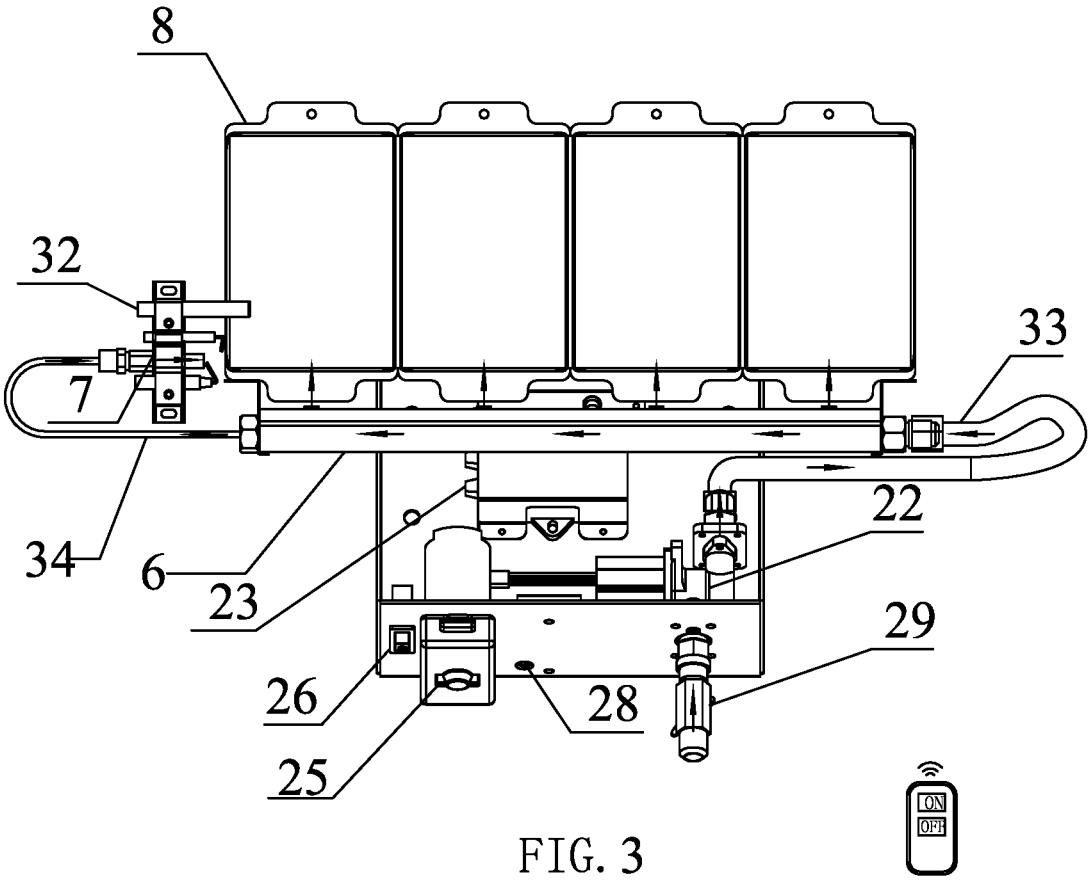
FIG. 3 is an internal view of the outdoor gas heater of the present invention.

The technical solutions of the embodiments in the present invention are clearly and completely described in combination with appended drawings of the invention.

The specific structure is shown in FIGS. 1-4, the outdoor gas heater comprises an outer cover 1, an outer cover side baffle 2, a gas injection pipe 6, a ceramic burner 8, a body box 18, a control box connecting support frame 19, a control box sealing plate 20, a control box 21, a wall-mounted bracket 30, a gas inlet pipe 33, and a long open flame connecting pipe 34. Four ceramic burners 8 are fixed side by side in the body box 18, a gas injection pipe 6 is fixed on the lower side of the body box 18 by screws and brackets, and a gas injection pipe 6 is sealingly connected to one end of the gas inlet pipe 33, four gas outlets are arranged side by side on the gas injection pipe 6, and the four gas outlets are respectively sealed to pass through the body box 18, and sealingly connected to the four ceramic burners 8 one by one, and gas is supplied to the four ceramic burners 8 through the gas injection pipe 6 respectively; the outer open end of the body box 18 is locked to the outer cover 1 via screws, and a plurality of through holes are arranged side by side on the outer cover 1, and the outer cover 1 is fixed with the outer cover side baffle 2 on both sides respectively; the side of the body box 18 opposite to the outer opening thereof is locked to the control box connecting support frame 19, the control box connecting support frame 19 is a U-shaped structure, and the side wall of which is locked on both sides of the control box 21 via screws, and the control box 21 is a rectangular hollow structure with an outside opening, the outer side opening of the control box 21 is locked to the control box sealing plate 20; the side of the control box 21 opposite to the outer opening is locked to the wall-mounted bracket 30;

The control box 21 is mainly provided with a solenoid valve 22, a signal processor 23, a battery box 25, and a remote control receiver 28, the solenoid valve 22 is locked at the bottom of the inner side of the control box 21, and the gas inlet of the solenoid valve 22 extends to the outside of the control box 21, and sealingly connected to the gas inlet pipe, the gas outlet of the solenoid valve 22 is sealingly connected to one end of the gas inlet pipe 33, to supply gas to the gas injection pipe 6, the other end of the gas injection pipe 6 is sealingly connected to one end of the long open flame connecting pipe 34, and the other end of the long open flame connecting pipe 34 is sealingly connected to a long open flame component 7, to supply gas to the long open flame component 7 through the long open flame connecting pipe 34; the solenoid valve 22 is connected to the signal processor 23 through a line, the signal processor 23 is locked at the top of the inside of the control box 21, the signal processor 23 is connected to the battery box 25 and the remote control receiver 28 through the line respectively, and the battery box 25 and the remote control receiver 28 are connected by the line, the battery box 25, the remote control receiver 28 are locked at the bottom of the inner side of the control box 21 respectively, the battery box 25 is provided with a battery that supplies electric energy to the signal processor 23, the remote control receiver 28, and the solenoid valve 22, when the ignition is successful, the power supply is no longer supplied to the solenoid valve 22, and only low-energy output maintains the signal transmission of the control box; an external remote controller is provided to match the remote control receiver 28, to control on/off.

A small switch 26 is fixed at the lower side of the control box 21, and the small switch 26 is connected to the output line of the battery box 25 through a line; the main function of the small switch is to manually turn on/off the power, get ready to operate before starting up, cut off power when not used; in addition, it can be used as a circuit protection manual switch.

The signal processor 23 is fixed by a signal processor platen 24, and the signal processor platen 24 is screwed to the top of the inner side of the control box 21.

The remote control receiver 28 is fixed by a remote control receiver platen 27, and the remote control receiver platen 27 is screwed to the bottom of the inner side of the control box 21.

The solenoid valve 22 extends to the gas inlet at the outside the control box 21 to sealingly connect the manual valve 29. The main function of the manual valve is to manually turn on/off the gas source, get ready to operate before starting up, cut off gads source when not used; in addition, it can be used as a gas circuit protection manual switch.

A long open flame component 7 is fixed on the left support plate 10 of the body box 18 via screws. The long open flame component 7 is disposed opposite to the lower part of the ceramic burner 8. The long open flame component, with model of 20341-F, adopts the prior art. Its main structure comprises a bracket, a sheet, an ignition nozzle, a nozzle, an ignition pin, an induction pin; the main function of the long open flame component 7 is to ensure long-term open flame to maintain the induction of the induction pin when the normal ignition of the ignition pin is successful, and when the open flame is extinguished unexpectedly, the induction pin will feed back the corresponding signal to cut off the solenoid valve 22, to avoid gas leakage.

The long open flame component 7 is sleeved with a thermocouple 32, the thermocouple 32 is connected to the signal processor 23 through a line, and the main function of the thermocouple 32 is used to supply power to maintain continuous work of the solenoid valve 22 after successful normal ignition.

A long open flame shelter box 5 is buckled on the outside of the long open flame component 7, and the long open flame shelter box 5 is fixed to the left support plate 10 of the body box 18.

The remote control receiver 28 is used to receive a switch signal of the remote controller, and then issue a corresponding command to the signal processor 23, to control the working of the ignition pin of the long open flame component 7.

After the signal processor 23 receives the power-on signals, the ignition pin of the long open flame component 7 starts to ignite and turn on the solenoid valve 22. After the ignition is successful, the induction pin of the long open flame component 7 will feel the flame temperature and continue to work.

The main function of the solenoid valve 22 is used to continuously receive the induction signals of the induction pin of the long open flame component 7 during normal operation, and cut off the gas supply when the signals are interrupted unexpectedly; in addition, cut off gas supply when shutdown signal is received from the remote controller.

The two inner sides of the body box 18 are respectively locked to a right support plate 9 and a left support plate 10, and the left end of the right support plate 9 is locked to the right burner-fixed bracket 15 via screws, the right end of the left support plate 10 is locked to the left burner-fixed bracket 16 via screws, and the upper end between the right burner-fixed bracket 15 and the left burner-fixed bracket 16 is respectively locked to both ends of the upper burner-fixed bracket 13 via screws, and the lower end between the right burner-fixed bracket 15 and the left burner-fixed bracket 16 is respectively locked to both ends of the lower burner-fixed bracket 14 via screws, the ceramic burners 8 are fixed side by side in a rectangular frame consisting of the right burner-fixed bracket 15, the left burner-fixed bracket 16, the lower bracket 14 and the upper bracket 13. During use, the first step is to fix the upper burner-fixed bracket 13, the lower burner-fixed bracket 14, the right burner-fixed bracket 15, and the left burner-fixed bracket 16 into a rectangular frame via screws and the second step is to fix the right support plate 9 and the left support plate 10 on the left side and right side respectively, and the third step is to put the ceramic burner 8 into the rectangular frame.

A ceramic plate intermediate baffle 31 is disposed between two adjacent ceramic burners 8, and the upper and lower ends of the ceramic plate intermediate baffle 31 are fixed on the upper bracket 13 and the lower bracket 14, respectively.

A ceramic plate upper platen 12 is disposed between the upper end of the ceramic burner 8 and the upper bracket 13, and a ceramic plate lower platen 11 is disposed between the lower end of the ceramic burner 8 and the lower bracket 14. During use, the ceramic plate lower platen 11, the ceramic plate upper platen 12 and the ceramic burner 8 were fixed in alignment with holes together on the upper bracket 13 and the lower bracket 14.

The upper side of the body box 18 is screwed to the water baffle 4, the water baffle 4 is a Z-shaped structure, and the water baffle 4 is shielded on the upper side of the outer cover 1 to prevent rainwater from entering the inside of the outer cover 1.

The inside of the outer cover 1 is provided with an outer cover bracket 3 at top and down, and the outer cover bracket 3 is locked on the body box 18 via screws.

The working principle (process) of the present invention:

1. Manually open the small switch and manual valve to turn on the power source and gas source;
2. Press the start button on the remote controller, and the remote control receiver in the body turns on the ignition pin of the long open flame component 7, to start ignition;
3. The solenoid valve opens the inlet gas and start to work after being ignited. During normal operation, the thermocouple generates electric energy to maintain the continuous operation of the solenoid valve. At this time, the power supply will no longer supply power to the solenoid valve, reducing the loss of the power supply and achieving working for a long time under an energy conservation state;
4. If the flame is unexpectedly extinguished, the ignition pin of the long open flame component 7 continues to ignite. If the ignition is unsuccessful, the solenoid valve automatically turns off and cuts off the gas;
5. During normal working, press the OFF key of the remoter controller, and the remote control receiver in the body box turns off the solenoid valve, to cut off the gas, to complete the process.

Figure 5:
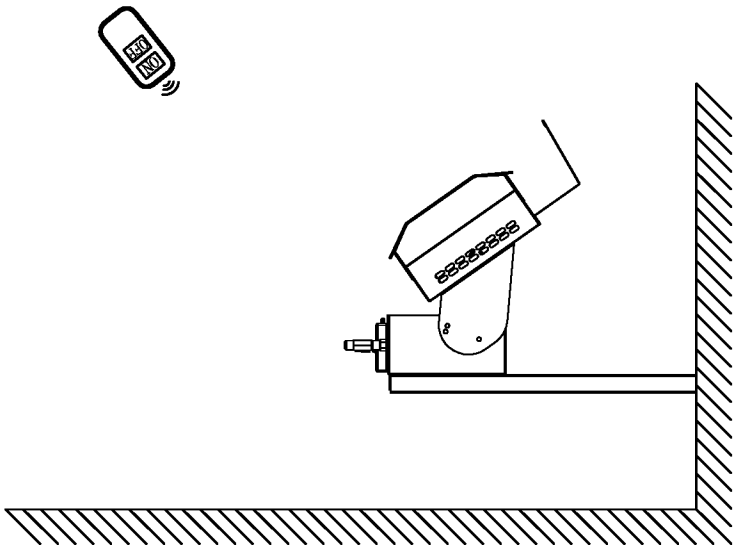
FIG. 5 is a schematic diagram of a ceiling structure of the outdoor gas heater according to the present invention.

As shown in FIG. 5, the outdoor gas heater of the present application can be fixed by a ceiling type structure.

Figure 6:
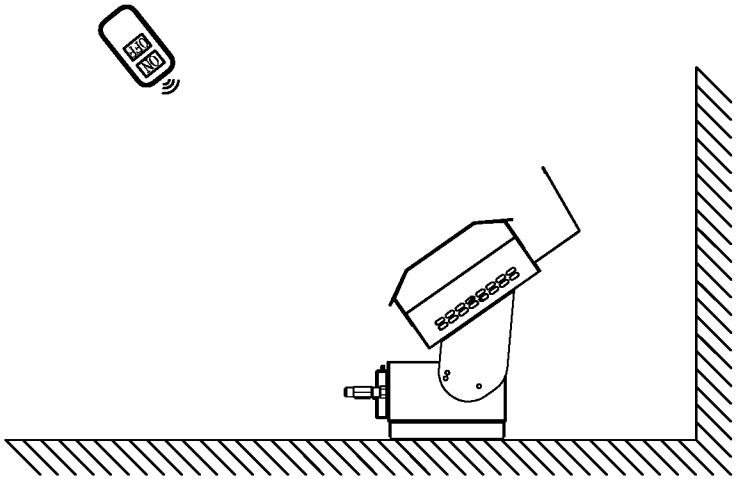
FIG. 6 is a schematic diagram of a wall-mounted structure of the outdoor gas heater according to the present invention.

As shown in FIG. 6, the outdoor gas heater of the present application can be fixed by a direct wall-mounted or indirect wall-mounted structure.

The foregoing description further describes the present invention in details in conjunction with the specific preferred embodiments, so that those skilled in the art can understand and use the present invention, but it does not limit the present invention. It is possible to those skilled in the art to make a number of simple deductions or substitutions that do not require creative work without departing from the inventive concept. Therefore, any simple modifications made by those skilled in the art to the invention shall fall within the scope of protection of the present invention.

The invention claimed is:

1. An outdoor gas heater, comprising an outer cover, an outer cover side baffle, a gas injection pipe, at least one ceramic burner, a body box, a control box connecting support frame, a control box sealing plate, a control box, a wall-mounted bracket and a long open flame connecting pipe, the body box is a rectangular hollow structure with an outside opening, four ceramic burners are fixed side by side in the body box, the gas injection pipe is fixed on the lower side of the body box, and the gas injection pipe is sealingly connected to one side of a gas inlet pipe, four gas outlets are arranged side by side on the gas injection pipe, and the four gas outlets are respectively sealed to pass through the body box, and sealingly connected to the four ceramic burners one by one, and gas is supplied to the four ceramic burners through the gas injection pipe respectively; an outer open end of the body box is locked to the outer cover, and the side of the body box opposite to the outer opening thereof is locked to the control box connecting support frame, the control box connecting support frame is a U-shaped structure, and a side wall of the control box connecting support frame is locked on both sides of the control box, and the control box is a rectangular hollow structure with an outside opening, an outer side opening of the control box is locked to the control box sealing plate; the side of the control box opposite to the outer opening is locked to the wall-mounted bracket.

2. The outdoor gas heater according to claim 1, wherein the control box is mainly provided with a solenoid valve, a signal processor, a battery box, and a remote control receiver, the solenoid valve is locked at the bottom of the inner side of the control box, and the gas inlet of the solenoid valve extends to the outside of the control box, and sealingly connected to the gas inlet pipe, the gas outlet of the solenoid valve is sealingly connected to one end of the gas inlet pipe, to supply gas to the gas injection pipe, the other end of the gas injection pipe is sealingly connected to one end of the long open flame connecting pipe, and the other end of the long open flame connecting pipe is sealingly connected to another long open flame component, to supply gas to the long open flame component through the long open flame connecting pipe; the solenoid valve is connected to the signal processor through a line, the signal processor is locked at the top of the inside of the control box, the signal processor is connected to the battery box and the remote control receiver through the line respectively, and the battery box and the remote control receiver are connected by the line, the battery box, the remote control receiver are locked at the bottom of the inner side of the control box respectively, the battery box is provided with a battery that supplies electric energy to the signal processor, the remote control receiver, and the solenoid valve, when the ignition is successful, the power supply is no longer supplied to the solenoid valve, and only low-energy output maintains the signal transmission of the control box; an external remote controller is provided to match the remote control receiver, to control on/off.

3. The outdoor gas heater according to claim 2, wherein the signal processor is fixed by a signal processor platen and a gland, and the signal processor platen is locked at the top of the inner side of the control box; the remote control receiver is fixed by a remote control receiver platen and a gland, and the remote control receiver platen is locked at the bottom of the inner side of the control box; the solenoid valve extends to the gas inlet at the outside the control box to sealingly connect the manual valve; the solenoid valve is used to continuously receive the induction signals of an induction pin of the long open flame component during normal operation, and cut off the gas supply when the signals are interrupted unexpectedly; in addition, cut off gas supply when shutdown signal is received from the remote controller.

4. The outdoor gas heater according to claim 3, wherein the long open flame component is fixed on the left support plate of the body box, and the long open flame component is disposed opposite to the lower portion of the ceramic burner, and the main structure comprises a bracket, a sheet, an ignition nozzle, a nozzle, an ignition pin, the induction pin; the long open flame component is used to ensure long-term open flame to maintain the induction of the induction pin when the normal ignition of the ignition pin is successful, and when the open flame is extinguished unexpectedly, the induction pin will feed back the corresponding signal to cut off the solenoid valve, to avoid gas leakage.

5. The outdoor gas heater according to claim 4, wherein the long open flame component is sleeved with a thermocouple, the thermocouple is connected to the signal processor through a line, and the thermocouple is used to supply power to maintain continuous work of the solenoid valve after successful normal ignition.

6. The outdoor gas heater according to claim 4, wherein a long open flame shelter box is buckled on the outside of the long open flame component, and the long open flame shelter box is fixed to the left support plate of the body box.

7. The outdoor gas heater according to claim 1, wherein the two inner sides of the body box are respectively locked to a right support plate and a left support plate, and the left end of the right support plate is locked to a right burner-fixed bracket, the right end of the left support plate is locked to a left burner-fixed bracket, and the upper end between the right burner-fixed bracket and the left burner-fixed bracket is respectively locked to both ends of the upper burner-fixed bracket, and the lower end between the right burner-fixed bracket and the left burner-fixed bracket is respectively locked to both ends of the lower burner-fixed bracket, the ceramic burners are fixed side by side in a rectangular frame consisting of the right burner-fixed bracket, the left burner-fixed bracket, the lower bracket and the upper bracket.

8. The outdoor gas heater according to claim 7, wherein a ceramic plate intermediate baffle is disposed between two adjacent ceramic burners, and the upper and lower ends of the ceramic plate intermediate baffle are fixed on the upper bracket and the lower bracket respectively.

9. The outdoor gas heater according to claim 7, wherein a ceramic plate upper platen is disposed between the upper end of the ceramic burner and the upper bracket, and a ceramic plate lower platen is disposed between the lower end of the ceramic burner and the lower bracket.

10. The outdoor gas heater according to claim 7, wherein the upper side of the body box is screwed to a water baffle, the water baffle is a Z-shaped structure, and the water baffle is shielded on the upper side of the outer cover to prevent rainwater from entering the inside of the outer cover; the inside of the outer cover is provided with an outer cover bracket at top and down, and the outer cover bracket is locked on the body box.

* * * * *